US006119656A

United States Patent [19]

Schmidt

[11] Patent Number: 6,119,656

[45] Date of Patent: Sep. 19, 2000

[54] PROCESS FOR OPERATING A FUEL INJECTION DEVICE

[75] Inventor: Eric Schmidt, Grosskrut, Australia

[73] Assignee: Robert Bosch GmbH, Stuttgart, Germany

[21] Appl. No.: 09/029,085

[22] Filed: Feb. 19, 1998

[30] Foreign Application Priority Data

Jun. 26, 1996 [DE] Germany ..... 196 25 487

[51] Int. Cl.[7] ..... F02M 41/00

[52] U.S. Cl. ..... 123/456; 123/198 D

[58] Field of Search ..... 123/456, 458, 123/497, 494, 198 D, 514, 446

[56] References Cited

U.S. PATENT DOCUMENTS

| | | | |
|---|---|---|---|
| 3,592,177 | 7/1971 | Wehde | 123/456 |
| 3,598,096 | 8/1971 | Timpner | 123/514 |
| 3,933,135 | 1/1976 | Zillman | 123/494 |
| 4,048,964 | 9/1977 | Kissel | 123/497 |
| 4,109,669 | 8/1978 | Riuere | 123/458 |
| 4,205,648 | 6/1980 | Graham | 123/497 |
| 4,727,748 | 3/1988 | Horigome et al. . | |
| 4,905,655 | 3/1990 | Maekawa | 123/494 |
| 4,971,005 | 11/1990 | Dyer | 123/494 |
| 5,085,193 | 2/1992 | Morikawa | 123/497 |
| 5,507,266 | 4/1996 | Wright | 123/497 |

FOREIGN PATENT DOCUMENTS

| | | |
|---|---|---|
| 0545450 | 6/1993 | European Pat. Off. . |
| 1922986 | 1/1971 | Germany . |
| 05006857 | 1/1993 | Japan . |

*Primary Examiner*—Carl S. Miller
*Attorney, Agent, or Firm*—Ronald E. Greigg; Edwin E. Greigg

[57] ABSTRACT

A method for operating a fuel injection system, and a fuel injection system for performing the method, in which the fuel is delivered at high pressure to a high-pressure fuel reservoir, whose pressure is controlled by a pressure control valve. By detecting the fuel quantities delivered to the high-pressure fuel reservoir and withdrawn in order to regulate the fuel pressure, including any control quantities that may occur, for the fuel injection system, a balance for the fuel quantities can now be prepared. This balance, is performed by a control unit which can now be used in order to compare the desired, set-point injection quantity with the actually injected or unintentionally escaping fuel quantity, and if these quantities differ significantly, to make an intervention into the operation of the fuel injection system or to trip a signal device.

12 Claims, 1 Drawing Sheet

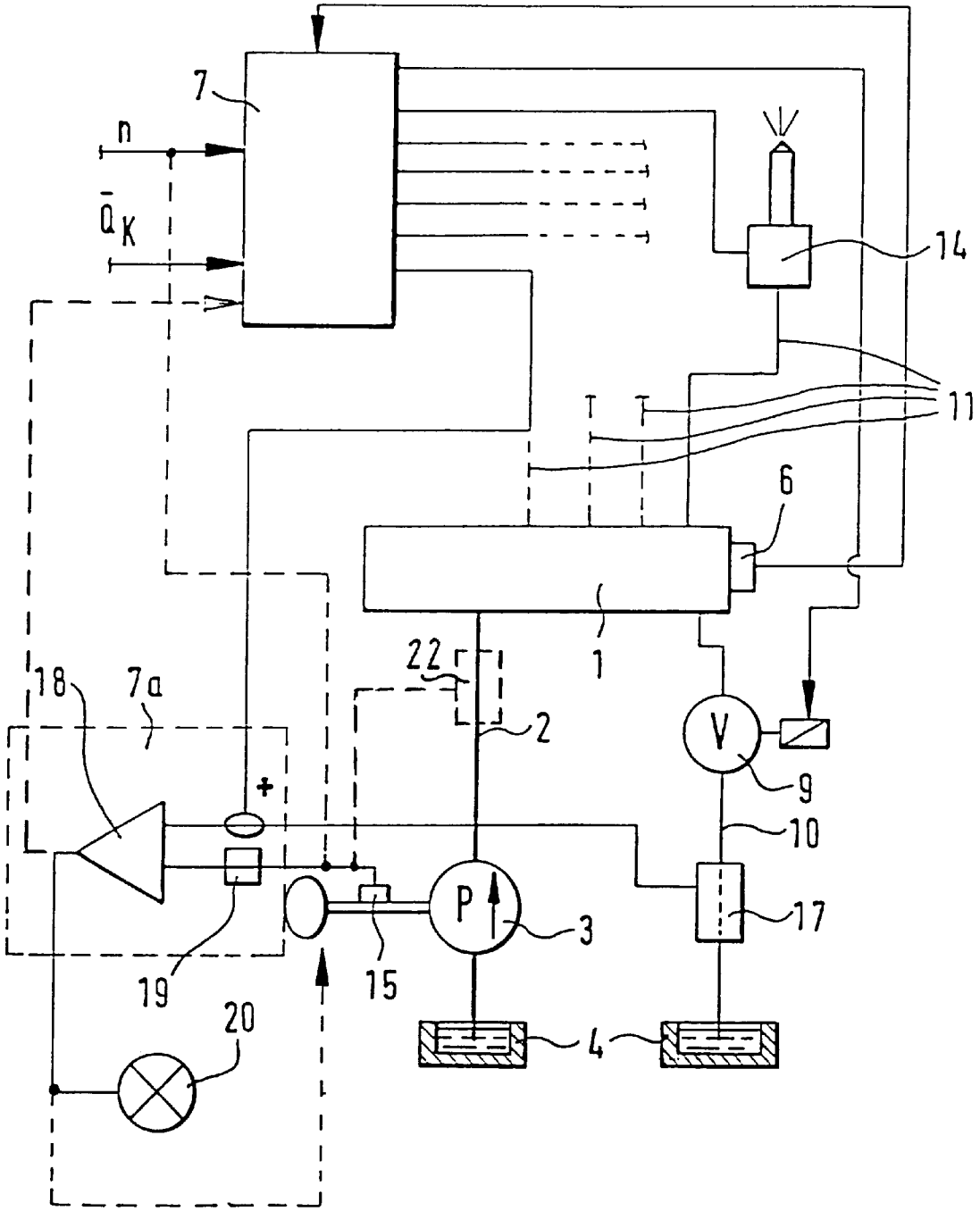
7
n
$\bar{Q}_K$
14
11
6
1
22
2
18
7a
+
V
9
10
P
3
17
19
15
20
4

PROCESS FOR OPERATING A FUEL INJECTION DEVICE

The invention is based on a method, known from U.S. Pat. No. 5,197,438, for operating a fuel injection system, in which the fuel is fed at high pressure into a high-pressure reservoir whose pressure is controlled by a pressure control valve, and from which fuel is withdrawn for injection via electrically controlled injection valves. In the fuel injection system operated in the known manner, it can happen that the high-pressure fuel reservoir system is no longer intact, which is especially critical, particularly in view of the high injection pressures for injecting fuel in self-igniting internal combustion engines.

Moreover, it can also happen that because of a malfunction the fuel quantity actually delivered to the high-pressure reservoir is not equal to the quantity that is intended for fuel injection and is required for pressure regulation.

With the method according to the invention for operating a fuel injection system of this generic type, it is now possible to ascertain in an exact way whether a malfunction is present in such a known high-pressure system, in particular in the high-pressure portion, such as in the vicinity of the high-pressure reservoir and the fuel injection valve. If a thus-detected malfunction should occur, then advantageously a warning can be given or a suitable intervention into the fuel injection system can be made directly in order to avert further damage.

In an especially advantageous way, and as recited in claim 2, the outflowing fuel required for regulating the fuel pressure in the high-pressure reservoir is detected in terms of its quantity by means of a flow quantity control device. Thus for a known delivery, detected by the quantity control device, of fuel brought to high pressure to the high-pressure fuel reservoir, and when there is a fuel injection quantity via the injection valves that is known from control parameters of the control unit, an exact balance for the delivered and withdrawn fuel is obtained, which now has a deviation only if a malfunction is involved.

Advantageously, a leakage quantity occurring in the high-pressure portion can be detected, and monitored whether the controlled fuel injection quantity in fact matches the actually injected fuel quantity.

In addition, instead of direct measurement of the high-pressure quantity delivered to the high-pressure reservoir, the quantity fed can easily be ascertained indirectly from the drive rpm of the fuel pump and its constant feed quantity per revolution of the drive shaft, and linked with the signals already needed for controlling the fuel injection valves and corresponding to the injected fuel quantity.

BRIEF DESCRIPTION OF THE DRAWING

An exemplary embodiment of the invention is shown in schematic form in the drawing and will be described in further detail in the ensuing description.

DESCRIPTION OF THE EXEMPLARY EMBODIMENT

Shown in the drawing is a high-pressure fuel reservoir 1, which is supplied with fuel that is brought to high injection pressure via a feed line 2 from a fuel pump 3, which aspirates fuel from a fuel tank 4. This involves pressures that are substantially above 1000 bar. The pressure in the high-pressure fuel reservoir is detected by a pressure transducer 6, whose signal is delivered to an electronic control unit 7, by means of which, if a fixedly set or desired pressure is exceeded, which pressure may be dependent on an applicable operating state of the associated internal combustion engine, a pressure control valve 9 connected to the high pressure fuel reservoir is triggered by a suitable signal. This valve is located in a fuel return line 10 from the high-pressure fuel reservoir to the fuel tank 4. Also leading away from the high-pressure fuel reservoir are pressure lines 11, which are each connected to one fuel injection valve 14, by way of which at the appropriate time a desired fuel quantity can be injected into different cylinders of the engine. The control of the fuel injection quantity in terms of timing and quantity is also effected via the control unit 7, which for this control purpose receives control signals corresponding to the rpm and load at which the associated engine is to be operated. The control of this fuel injection quantity is effected for instance in a known manner by magnet valves, which control the communication between the high-pressure reservoir and the fuel injection valve. Any fuel control quantities that may occur and flow back into the tank can also be returned to the tank via the return line 10.

The fuel pump is driven, for instance in synchronism with the engine operated by the fuel injection system, or in other words at an rpm that is already detected for controlling the injection. Alternatively, however, the fuel pump can be operated separately by a special drive mechanism, and then the respective drive rpm of the fuel pump can also be detected, for instance by an rpm transducer 15. With the aid of this drive rpm and of the fact that the fuel pump feeds a constant feed quantity per revolution, it is now possible indirectly, with the aid of this rpm, to detect the fuel quantity delivered to the high-pressure fuel reservoir, so that a flow quantity control device for directly measuring the fuel quantity supplied can be dispensed with. But even if for certain reasons the fuel feed pump has a variable feed volume, the fuel quantity fed by it can still be detected from the control signals, or advantageously by means of a quantity control device 22.

Since in the operation of the fuel injection system at very high pressures it is critical if leaks occur in the high-pressure system, especially the high-pressure reservoir 1, it is necessary that the intactness of this reservoir be monitored. Since the supply of high-pressure fuel in this injection system takes place not intermittently but rather from a constantly filled high-pressure reservoir, it is furthermore also highly important to ascertain whether the fuel injection valves are functioning properly, because otherwise considerable engine damage can occur. With the aid of the fuel quantity delivered via the feed pump 3 and the fuel quantity withdrawn via the fuel injection valves 14, in conjunction with the fuel quantity withdrawn to regulate the fuel pressure in the high-pressure reservoir and the control quantities that may occur for the injection system, a balance for the delivered fuel and the withdrawn fuel can now be established. To that end, however, the fuel quantity diverted via the pressure control valve 9 must be measured by means of a flow quantity control device 17 in the fuel return line 10. The signal corresponding to this quantity, added to a signal corresponding to the total fuel injection quantity in the unit of time, the latter signal being outputtable by the control unit, is now compared, with the aid of a comparison device 18, with the correspondingly processed signal for the feed quantity of the feed pump 3 based on the rpm signal. If the fuel quantity delivered and the fuel quantity withdrawn again differ, then by means of the control unit 7*a*, tripped by the comparison device 18, a signal is output for a display 20 or for an intervention into the operation of the fuel injection system. With this signal, the drive of the fuel pump 3 can for instance be turned off, or the entire fuel injection system in the engine can be shut down or reduced to an emergency mode.

If the indirect measurement of the fuel quantity delivered to the high-pressure reservoir is replaced by a direct measurement, as mentioned above, then where there is an high-pressure reservoir assumed to be intact, not only high-pressure lines but also the function of the fuel injection valves can be monitored. To that end, a flow quantity control device 22, shown in dashed lines in the drawing, is again inserted into the feed line 2; it can be called the first flow quantity control device, in contrast to the second flow quantity control device 17 in the fuel return line 10. This produces an actual value for the fuel quantity injected. This value is compared with the set-point injection quantity specified to the control unit. From the result of the comparison it can be found whether the fuel injection valves are functioning without error, and if needed a correction value for the control unit can be formed.

As the flow quantity control device 17, in a manner known per se, a throttle inserted into the fuel return line 10 can be provided and the pressures upstream and downstream of the throttle can be compared with one another so as to form a quantity signal therefrom. Such flow quantity control devices are described for instance in conjunction with injection systems in German Patent Application DE-A 37 22 264. It is also possible to use other suitable sensors. For instance, a sensor already used for some other purpose can advantangeously be used economically, an example being sensors that are also used for measuring the air flow rate and that are known in terms of their physical design from German Patent Application DE-A 29 19 433.

The foregoing relates to preferred exemplary embodiments of the invention, it being understood that other variants and embodiments thereof are possible within the spirit and scope of the invention, the latter being defined by the appended claims.

What is claimed is:

1. A method for operating a fuel injection system, which comprises feeding fuel from a high pressure pump at a high pressure into a high-pressure reservoir (1), controlling the pressure in the high pressure reservoir by a pressure control valve (9), controlling a withdrawal of fuel from said high pressure reservoir by a control unit for injection via at least one fuel injection valve (14), monitoring the injection system to detect any malfunction in the injection system, comparing the fuel quantity delivered to the high-pressure reservoir (1) with the fuel quantity withdrawn from said high-pressure reservoir, and if the quantities differ from one another, displaying a generated signal for a visual display or for influencing the operation of the fuel injection system.

2. A method in accordance with claim 1, which comprises measuring the fuel quantity delivered to the high-pressure reservoir (1) by a first quantity control device (22), and measuring the fuel quantity withdrawn from the high-pressure reservoir (1), by use of a second quantity control device (17) in order to maintain a high pressure in said high-pressure reservoir and comparing the values measured by said first and second quantity control devices with the fuel injection quantity specified to the fuel quantity control device for controlling the fuel injection valves.

3. A method in accordance with claim 2, in which the quantity control device for measuring the fuel quantity delivered to the high-pressure reservoir (1) comprises a device (15) related to a drive shaft that drives the pump for detecting the drive rpm of the high-pressure feed pump (3) that feeds the fuel at a high pressure, at a geometrically constant feed quantity per revolution; the detection of the control value of the fuel injection quantity in the unit of time is effected from signals for controlling the injection quantity; and the detection of the fuel quantity withdrawn from the high-pressure reservoir (1) in order to maintain the pressure therein is effected by means of the second quantity control device (17) that measures the fuel quantity withdrawn from the high-pressure reservoir.

4. A fuel injection system which comprises a high-pressure feed pump (3), which feeds fuel at a constant feed rate to a high-pressure reservoir (1), said high-pressure reservoir communicates via a plurality of pressure lines (11) each with one fuel injection valve (14), wherein an inflow to the individual fuel injection valves (14) is effected by means of electrically controlled valves, and the high-pressure reservoir (1) can be relieved via a fuel return line (10), a pressure control valve (9) in said fuel return line, said pressure control valve (9) is controlled as a function of the pressure in the high-pressure reservoir, a flow quantity control device (17) is disposed in the fuel return line (10) downstream of said pressure control valve (9), said control valve (17) communicates with a control unit **(7, 7*a*, 18, 19), which includes a fuel fed volume device (19) for detecting a volume of fuel fed by the high-pressure feed pump (3) in a unit of time; an electronic control device (7) for detecting the fuel quantity injected in a unit of time and a signal comparison device (18)** for ascertaining a difference between the fuel quantity fed into the high-pressure reservoir and a sum of the fuel quantities detected by the flow quantity control device and the fuel quantity injected in the unit of time and for forming a signal for visual display or influencing the operation of the fuel injection system if a difference occurs.

5. A fuel injection system which comprises a high-pressure feed pump (3), which feeds fuel via a fuel inlet line to a high-pressure reservoir (1), said high-pressure reservoir communicates via a plurality of pressure lines (11) each with one fuel injection valve (14), wherein an inflow of fuel to the individual fuel injection valves (14) is effected by means of electrically controlled valves, and the high-pressure reservoir (1) can moreover be relieved of a high-pressure via a pressure control valve (9) in a fuel return line (10) controlled as a function of the pressure in the high-pressure reservoir, a first flow quantity control device (22) is disposed in the fuel inlet line to the high-pressure reservoir, and in the fuel return line (10) from the high-pressure reservoir downstream of the pressure control valve (9) a second flow quantity control device (17) is disposed, each of said first and second flow quantity control devices (22 and 17) communicate with a control unit **(7, 7*a*, 18, 19), which by triggering the fuel injection valves controls the fuel quantity to be injected into the cylinder of an engine in a unit of time as specified, and which has a device (18)** for forming a difference between the fuel quantity fed into the high-pressure reservoir detected by the first flow quantity control device and the returned fuel quantities detected by the second flow quantity control device, which as an actual fuel quantity injected via the fuel injection valves is compared by the control unit with a set value, to be controlled, of the fuel injection quantity, and if they differ a signal is formed for visual display or for influencing the operation of the fuel injection system.

6. A fuel injection system in accordance with claim 4, in which the control unit **(7, 7*a*) has a fuel quantity control device, which receives signals for a demanded load ($Q_k$) and signals for the rpm (n) of the engine from an rpm signal source, by means of said fuel quantity control device, control signals for controlling the electrically controlled injection valves (14) are generated, and these signals, for detecting the fuel quantity drawn from the high-pressure reservoir for injection, are delivered to the comparison device (18), which also receives signals from a device (19) that communicates with the rpm signal source or an rpm transducer (15)**, which at least indirectly detects the drive rpm of the high-pressure feed pump, in order to detect the volume fed by the feed pump.

7. A fuel injection system in accordance with claim 4, in which the flow quantity control device has a flow throttle, which is disposed in the fuel inflow or return line, and having a measuring device for measuring the pressure drop prevailing at said flow throttle, as a measure of the flow quantity.

8. A fuel injection system in accordance with claim 5, in which the flow quantity control device has a flow quantity control device has a flow throttle, which is disposed in the fuel inflow or return line, and having a measuring device for measuring the pressure drop prevailing at said flow throttle, as a measure of the flow quantity.

9. A fuel injection system in accordance with claim 6, in which the flow quantity control device has a flow throttle, which is disposed in the fuel inflow or return line, and having a measuring device for measuring the pressure drop prevailing at said flow throttle, as a measure of the flow quantity.

10. A fuel injection system in accordance with claim 4, in which a hot-film mass sensor is used as the flow quantity control device.

11. A fuel injection system in accordance with claim 5, in which a hot-film mass sensor is used as the flow quantity control device.

12. A fuel injection system in accordance with claim 6, in which a hot-film mass sensor is used as the flow quantity control device.

* * * * *

UNITED STATES PATENT AND TRADEMARK OFFICE

CERTIFICATE OF CORRECTION

PATENT NO. : 6,119,656
DATED : September 19, 2000
INVENTOR(S) : Eric Schmidt

It is certified that error appears in the above-identified patent and that said Letters Patent is hereby corrected as shown below:

Please add the international number to read as follows:

[86] PCT No.: PCT/DE 97/00293
371 Date: February 14, 1997
102(e) Date: February 14, 1997

Signed and Sealed this

Third Day of July, 2001

*Attest:*

Nicholas P. Godici

*Attesting Officer*

NICHOLAS P. GODICI
*Acting Director of the United States Patent and Trademark Office*